US012685334B2

(12) United States Patent
Dittmann et al.

(10) Patent No.: US 12,685,334 B2
(45) Date of Patent: Jul. 21, 2026

(54) AEROSOL-GENERATING DEVICE, SYSTEM AND METHOD

(71) Applicant: Philip Morris Products S.A., Neuchatel (CH)

(72) Inventors: Leander Dittmann, Pully (CH); Robert Emmett, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 346 days.

(21) Appl. No.: 18/251,092

(22) PCT Filed: Nov. 4, 2021

(86) PCT No.: PCT/EP2021/080666
§ 371 (c)(1),
(2) Date: Apr. 28, 2023

(87) PCT Pub. No.: WO2022/096589
PCT Pub. Date: May 12, 2022

(65) Prior Publication Data

US 2023/0397659 A1 Dec. 14, 2023

(30) Foreign Application Priority Data

Nov. 6, 2020 (EP) ..... 20206314

(51) Int. Cl.
*A24F 47/00* (2020.01)
*A24F 40/05* (2020.01)
(Continued)

(52) U.S. Cl.
CPC ..... *A24F 40/05* (2020.01); *A24F 40/10* (2020.01); *A24F 40/53* (2020.01); *A24F 40/42* (2020.01)

(58) Field of Classification Search
CPC ..... A24F 40/05; A24F 40/10; A24F 40/42; A24F 40/50
See application file for complete search history.

(56) References Cited

U.S. PATENT DOCUMENTS 7,252,085 B2 8/2007 Kunschir
2002/0033795 A1* 3/2002 Shahoian ..... G06F 3/03547 345/156
(Continued)

FOREIGN PATENT DOCUMENTS

CN 105473014 A 4/2016
CN 108472460 A 8/2018
(Continued)

OTHER PUBLICATIONS

Combined Russian Notice of Allowance and Search Report issued Apr. 1, 2025, in corresponding Russian Patent Application No. 2023114671/03(031215) (with English Translation of Category of Cited Documents), 11 pages.
(Continued)

*Primary Examiner* — Eric Yaary
(74) *Attorney, Agent, or Firm* — Oblon, McClelland, Maier & Neustadt, L.L.P.

(57) ABSTRACT

An aerosol-generating device is provided, including: a vibratable transducer configured to aerosolise a liquid aerosol-forming substrate; and a controller coupled to the transducer, the controller being configured to provide a driving signal for vibrating the transducer, in which all or part of the driving signal defines a sensory output of the transducer detectable by at least one of an auditory sense of a user and a touch sense of a user, and adjust the driving signal such that the sensory output is indicative of a state of the aerosol-generating device. An aerosol-delivery system, and
(Continued)

a method of operating an aerosol-generating device having a vibratable transducer, are also provided.

9 Claims, 12 Drawing Sheets

(51) Int. Cl.

| | |
|---|---|
| ***A24F 40/10*** | (2020.01) |
| ***A24F 40/53*** | (2020.01) |
| *A24F 40/42* | (2020.01) |

(56) References Cited

U.S. PATENT DOCUMENTS

| | | | | |
|---|---|---|---|---|
| 2015/0020825 | A1* | 1/2015 | Galloway | G08B 6/00 340/407.1 |
| 2017/0119052 | A1 | 5/2017 | Williams et al. | |
| 2017/0243452 | A1* | 8/2017 | Levesque | G06F 3/016 |
| 2019/0166918 | A1* | 6/2019 | Thorsen | A24F 40/50 |
| 2020/0046918 | A1 | 2/2020 | Selby | |
| 2020/0170301 | A1 | 6/2020 | Gallagher et al. | |
| 2020/0197629 | A1 | 6/2020 | Miller et al. | |
| 2020/0329763 | A1* | 10/2020 | Kerr | A61M 15/0066 |
| 2021/0260312 | A1 | 8/2021 | Lacour-Gayet et al. | |

FOREIGN PATENT DOCUMENTS

| | | | |
|---|---|---|---|
| EA | 30936 | B1 | 10/2018 |
| EA | 34535 | B1 | 2/2020 |
| IN | 202037002153 | A | 2/2020 |
| JP | 2016-525348 | A | 8/2016 |
| JP | 2019-502364 | A | 1/2019 |
| JP | 2019-150028 | A | 9/2019 |
| RU | 2 735 592 | C1 | 11/2020 |
| WO | WO 2019/239217 | A1 | 12/2019 |
| WO | WO 2020/008028 | A1 | 1/2020 |
| WO | WO 2021/175869 | A1 | 9/2021 |

OTHER PUBLICATIONS

International Search Report & Written Opinion issued Feb. 4, 2022 in PCT/EP2021/080666 filed on Nov. 4, 2021, 9 pages.

Extended European Search Report issued Apr. 20, 2021 in European Patent Application No. 20206314.5, 10 pages.

Japanese Notice of Reasons for Refusal issued Oct. 28, 2025, in Japanese Patent Application No. 2023-526264, 7 total pages (with English Translation).

Office Action dated Apr. 16, 2026 issued in corresponding Chinese Patent Application No. 202180073993.3 (with English translation).

* cited by examiner

AEROSOL-GENERATING DEVICE, SYSTEM AND METHOD

The present disclosure relates to an aerosol-generating device for aerosolising a liquid aerosol-forming substrate through use of a vibratable transducer. The present disclosure also relates to an aerosol-delivery system including such an aerosol-generating device. The present disclosure further relates to a method of operating an aerosol-generating device having a vibratable transducer. Additionally, the present disclosure relates to a non-transitory computer-readable medium for use with an aerosol-generating device.

Known vibrating nebulizers for aerosolising a liquid aerosol-forming substrate employ a membrane having a distribution of nozzles. The membrane is coupled to an actuator, with the actuator functioning to induce vibration of the membrane. On contact of the membrane with a liquid aerosol-forming substrate, the vibrating action of the membrane results in the liquid aerosol-forming substrate being pushed through the nozzles to form aerosol droplets.

The present disclosure relates to provision of an aerosol-generating device having a capability to provide a user with feedback.

According to an aspect of the present disclosure, there is provided an aerosol-generating device comprising: a vibratable transducer for aerosolising a liquid aerosol-forming substrate; and a controller coupled to the transducer. The controller is configured to provide a driving signal for vibrating the transducer, in which all or part of the driving signal defines a sensory output of the transducer detectable by at least one of: an auditory sense of a user and a touch sense of a user.

As used herein, the term "vibratable transducer" refers to a device configured to convert energy from an initial form into a different form, where the different form comprises or consists of a vibratory output.

As used herein, the term "auditory sense of a user" refers to a user's sense of hearing.

As used herein, the term "auditory frequency range of human hearing" refers to a frequency range of 20 Hz to 20 kHz, which is generally accepted to be the frequency range detectable by the hearing sense of a typical human being.

As used herein, the term "touch sense of a user" refers to a user's tactile sense, which may otherwise be known as the user's sense of touch.

As used herein, the term "liquid" refers to a substance provided in liquid form and encompasses substances provided in the form of a gel.

For the present disclosure, the driving signal may both i) induce vibration of the transducer (or a component part thereof) and ii) provide, through operation of the transducer, a sensory output detectable to a user of the aerosol-generating device. The sensory feedback from the transducer may be detectable by a user through either or both of the user's sense of hearing or the user's sense of touch. Tactile sensory feedback may be sensed through a user touching a surface of the aerosol-generating device, or through the user touching a surface of a system of which the device forms part.

The term "controller" encompasses any control electronics and processor(s) configured for use in creating, adapting and providing the driving signal to the vibratable transducer, as well as any computer-readable medium storing instructions for use in the creating, adapting and providing of the driving signal to the vibratable transducer. By way of example, the controller may take the form of control electronics and a non-transitory computer readable medium (such as a computer memory module), in which the control electronics comprise a control unit coupled to or containing the non-transitory computer readable medium. The control unit may itself contain or be coupled to a computer processor. The non-transitory computer readable medium may contain instructions for use in the creating, adapting and providing of the driving signal to the vibratable transducer.

Preferably, the controller is configured such that the driving signal comprises one or more resonant frequencies of the vibratable transducer. Driving the transducer at one or more of its resonant frequencies may assist in maximising aerosol generation by the vibratable transducer in an energy-efficient manner.

Preferably, the controller is operable to switch between: a first operating condition in which the driving signal comprises one or more resonant frequencies of the vibratable transducer; and a second operating condition in which the driving signal excludes any resonant frequency of the vibratable transducer. Typically, the resonant frequencies would be associated with aerosol generation. In contrast, the exclusion from the driving signal of any of the resonant frequencies of the vibratable transducer would be associated with a substantial reduction in or prevention of aerosol generation. Therefore, having the controller configured to switch between first and second operating conditions, as described above, may allow the transducer to be switched from a first operating condition in which aerosol is generated by the vibrating action of the transducer, to a different, second operating condition in which aerosol generation is substantially reduced or prevented. By "substantially reduced" is meant that the volume of aerosol generated in a given time period by the transducer in the second operating condition is 5% or less of the volume of aerosol generated in the same given time period by the transducer in the first operating condition. So, the first operating condition may correspond to an aerosol-generation mode for the transducer of the aerosol-generating device. In contrast, the second operating condition may correspond to a reduced aerosol-generation mode or a standby mode for the transducer of the aerosol-generating device. The terms "first" and "second" are used here merely to indicate that both operating conditions differ from each other and do not require that the second operating condition occurs after the first operating condition.

Conveniently, the transducer may comprise a membrane. The membrane may have an aerosol generation zone provided with a plurality of nozzles for the passage there through of liquid aerosol-forming substrate. As used herein, the term "nozzle" refers to an aperture, hole or bore through the membrane that provides a passage for liquid aerosol-forming substrate to move through the membrane. By way of example and without limitation, during use of the aerosol-generating device a liquid aerosol-forming substrate may be brought into contact with a first side of the membrane. Vibration of the membrane may result in a portion of the liquid substrate being urged and expelled through the nozzles so as to be emitted as a spray of aerosol droplets from a second opposing side of the membrane.

Preferably, the nozzles are circular in shape. The use of nozzles which are circular in shape is preferred because the circular shape maximizes the ratio of area to perimeter of the respective nozzle, therefore reducing viscous drag forces and boundary layer build-up. However, the use of nozzles which are elliptical in shape has also been found to result in acceptable performance in terms of the resulting aerosol droplet formation.

The membrane may be formed of any suitable material. By way of example and without limitation, the membrane may be formed of a polymer material, thereby providing advantages of reduced mass and inertia. However, the membrane may be formed of any other material, such as a metallic material. The membrane may be a composite of two or more different materials. The choice of material(s) used for the membrane may be influenced by the particular liquid aerosol-forming substrate(s) intended to be used with and aerosolised by the aerosol-generating device. For example, it is highly desirable to choose a material for the membrane which does not chemically react with or degrade as a consequence of contact with the chosen liquid aerosol-forming substrate. By way of example only, the membrane may be formed of any of palladium, stainless steel, copper-nickel alloy, polyimide, polyamide, silicon or aluminium nitride.

Advantageously, the membrane may be circular in profile. A circular-profiled membrane has been found beneficial when the aerosol-generating device is used in a smoking system in the form of an elongated cylindrical smoking article. The use of the aerosol-generating device in or as a smoking article is described in more detail below.

The vibratable transducer may further comprise an actuator coupled to the membrane, the actuator configured to be driven by the driving signal so as to cause the membrane to vibrate at a frequency suitable for the generation of aerosol. For example and without limitation, the actuator may comprise one or more piezo-electric actuators. Piezo-electric actuators are preferred because they provide an energy-efficient and lightweight means of inducing vibration of the membrane, possessing a high energy conversion efficiency from electric to acoustic/mechanical power. Further, piezo-electric actuators are available in a wide variety of materials and shapes. For a piezo-electric actuator, inputting an electrical driving signal to the piezo-electric actuator would result in a mechanical output in the form of a vibration signal. The vibration signal output from the actuator would, in turn, induce a vibration of the membrane. Tuning and adjustment of the electrical driving signal being input to the piezo-electric actuator may result in corresponding changes in the vibration signal output from the actuator, thereby resulting in adjustment of the vibratory response of the membrane. By way of example and without limitation, the tuning and adjustment may include varying any of the amplitude, frequency or wavelength of the electrical driving signal. The adjustment in the membrane's vibratory response may include a change in one or both of a vibratory frequency of the membrane and an amplitude of vibration of the membrane.

Conveniently, the actuator may be annular in form and extend around a periphery of the membrane. The annular actuator may have the form of a continuous or segmented ring.

Preferably, the controller may be configured to adjust the driving signal such that the sensory output is indicative of a state of the aerosol-generating device. The adjustment of the driving signal may comprise adjusting a parameter of the driving signal, the parameter being one or more of a frequency, a wavelength and an amplitude of the driving signal. Conveniently, the state may comprise one or more of the following: a temperature state of the aerosol-generating device; an energy state of the aerosol-generating device; a fault condition of the aerosol-generating device; a number of puffs applied by a user to the aerosol-generating device; and a phase of a usage session of the aerosol-generating device. By way of example, in embodiments in which the device also comprises a heating element for heating the liquid aerosol-forming substrate, the temperature state may be representative of the aerosol-generating device being in a pre-heating mode, or of the aerosol-generating device having attained a target operating temperature, or of the aerosol-generating device being in an overheated state. In a further example, the energy state may be representative of an energy state of a power source (for example, a battery) used to power the aerosol-generating device. By way of further example, the fault condition may be representative of a fault with the transducer, controller or other component part of the aerosol-generating device.

Additionally, the aerosol-generating device may further comprise a light source. The light source may be configured to emit a light signal. Further, the controller may be configured to adjust the light signal emitted from the light source so as to be indicative of the state of the aerosol-generating device. As used herein, the term "light" refers to an emission of electromagnetic radiation in the visible portion of the electromagnetic spectrum, i.e. generally in the range of 380 nm to 760 nm. By way of example and without limitation, the device may be configured to: emit a first light signal from the light source when the device is in a first state; and emit a second light signal from the light source when the device is in a second state. The first light signal and the second light signal are different to each other. The first light signal and second light signal may be different to each other in one or more of colour, duration, or periodicity. By way of example, one or both of the first or second light signals may be formed of a single pulse of fixed duration, or a sequence of pulses. For the sequence of pulses, each pulse of the sequence may have the same duration, or one or more of the pulses in the sequence may be different to other pulses in the series. The use of distinct first and second light signals has a beneficial effect of providing a user with visual feedback in addition to either or both of auditory and tactile feedback, with the feedback providing an indication of the aerosol-generating device being in a given state. In this manner, the aerosol-generating device may be provided with the capability to provide sensory feedback to a user which can be perceived by multiple senses of a user, i.e. eyesight, hearing and tactile. The use of sensory feedback in multiple formats may be particularly beneficial to users who have a physical impairment with one of their senses.

Preferably, the controller is configured such that the driving signal comprises at least one predetermined frequency, whereby the sensory output comprises the at least one predetermined frequency. In this manner, the sensory output is characterised in terms of its frequency, with that same frequency being present in the driving signal for the vibratable transducer. Use of a predetermined frequency within the auditory frequency range of human hearing (20 Hz to 20 kHz) provides for the driving signal of the transducer to provide the sensory output as a sound detectable to human hearing. Where the sensory output is intended to be a sound detectable to a user's auditory sense, the amplitude of the driving signal (or a component part of the driving signal) would influence the perceived loudness of the sound at the predetermined frequency. In an embodiment where the vibratable transducer comprises a membrane (as discussed above), the driving signal may cause the surface of the membrane to act like the diaphragm of a loudspeaker by vibrating with a frequency (i.e. the "predetermined frequency") detectable by the auditory sense of a user. Where the sensory output is intended to be detectable to a user's tactile sense, the amplitude of the driving signal (or a component part of the driving signal) would influence the strength of vibrations at the predetermined frequency as sensed by the user.

Conveniently, the controller is configured such that the driving signal comprises a sequence of two or more predetermined frequencies, wherein the sensory output comprises the sequence of the two or more predetermined frequencies. The sequence of two or more predetermined frequencies may comprise a series of pulses, with one pulse of the series having a first predetermined frequency and another pulse of the series having a second predetermined frequency. Each pulse in the series may be of equal length; alternatively, one or more of the pulses in the series of pulses may differ in length from other pulses in the series. Additionally or alternatively, a gap between consecutive pulses in the series of pulses may be uniform for all pulses in the series, or the gap may vary between different consecutive pulses of the series. Where the sequence of two or more predetermined frequencies is within the auditory frequency range of human hearing, the sequence would be perceived as a sequence of tones of different pitch.

Conveniently, the controller may be configured such that the sequence of two or more predetermined frequencies defines an auditory output of one or more spoken words. By way of example and without limitation, the one or more spoken words may provide an indication of a state of the aerosol-generating device. Alternatively or in addition, the one or more spoken words may contain instructions intended to be executed by a user in the operation of the device.

Preferably, the controller may be configured such that the at least one predetermined frequency is less than 5 kHz, or more preferably, to be within a range of 60 Hz to 4 kHz. Such a limitation may be particularly applicable to when the at least one predetermined frequency defines an auditory output comprising one or more spoken words, with most human speech being less than 5 kHz in frequency, and typically confined within the frequency range of 60 Hz to 4 kHz.

In some more complex scenarios, the sequence of two or more predetermined frequencies may define a musical composition within the auditory frequency range of human hearing.

Conveniently, the at least one predetermined frequency may comprise one or more of an up-chirp and a down-chirp. As used herein, the term "up-chirp" refers to a signal which monotonically increases in frequency over the duration of the signal, whereas the term "down-chirp" refers to a signal which monotonically decreases in frequency over the duration of the signal.

Conveniently, the controller may be configured such that the at least one predetermined frequency lies within a range of 0.1 Hz to 20 kHz. The range of 0.1 Hz to kHz encompasses and extends lower than the auditory frequency range for human hearing. Although frequencies below 20 Hz are not usually detectable to human hearing, such frequencies may be detectable by a user's tactile sense. For example, if the controller is configured such that the driving signal comprises a predetermined frequency of 0.5 Hz, the signal would provide a sensory output perceivable by a user's tactile sense as a continuous series of pulses occurring at a rate of one pulse every two seconds. As discussed above, the degree to which the sensory output at a given predetermined frequency is detectable to a user's auditory or tactile senses may also be dependent on the amplitude of the driving signal (or a component part thereof).

Preferably, the controller is configured such that the driving signal comprises a carrier signal and a modulating signal. The modulating signal may be modulated onto the carrier signal, with the modulating signal comprising the at least one predetermined frequency. The carrier signal may have a frequency optimised for inducing aerosol-generation by the vibratable transducer, such as one of the resonant frequencies of the vibratable transducer (or a component part thereof). The resonant frequencies of the transducer will vary according to the materials, construction and constraints on the transducer or its component parts. However, these resonant frequencies are likely to be above the upper frequency limit detectable by human hearing (generally accepted to be around 20 kHz) or by a user's tactile sense. So, providing the driving signal which has a carrier signal modulated by a modulating signal may be beneficial in enabling the driving signal to achieve both: i) aerosol generation by the transducer (by virtue of the frequency composition of the carrier signal) and ii) providing either or both auditory and tactile sensory feedback to a user of the device (by virtue of the value(s) of the at least one predetermined frequency of the modulating signal). The advantages of modulation can be understood by considering a scenario of the driving signal solely consisting of a carrier signal with a single frequency component within the auditory frequency range of human hearing (i.e. 20 Hz to 20 kHz). The use of such a driving signal confined to this frequency range would generate a sound detectable to a user's hearing. However, as the frequency is likely to be well below any of the resonant frequencies of the transducer, the driving signal would be unlikely to result in the vibratable transducer being energised sufficiently to result in the generation of any aerosol.

The degree of modulation of the carrier signal by the modulating signal may be characterised in various ways. The modulation may be by way of amplitude modulation or frequency modulation. Conveniently, the modulating signal may be amplitude modulated onto the carrier signal with a modulation depth in a range of 10% to 100%. Alternatively or in addition, the modulating signal may be frequency modulated onto the carrier signal with a frequency deviation of between 1% to 50% of the carrier signal frequency.

Preferably, the controller is configured such that the driving signal comprises a carrier signal and a secondary signal, in which a frequency difference between the carrier signal and the secondary signal defines the predetermined frequency, the predetermined frequency being no greater than 20 kHz. By limiting the frequency difference and thereby the predetermined frequency to being no greater than 20 kHz, a sensory output is provided that may be perceived by a user's auditory and/or tactile senses as a series of beats having the predetermined frequency. Advantageously, the frequency difference and thereby the predetermined frequency may be confined to lie within a range of 20 Hz to 20 kHz, thereby providing an advantage that the frequency difference would result in a sensory output in the form of a sound within the auditory frequency range of human hearing. Preferably, the controller is configured such that the secondary signal is a modulating signal. More preferably, the modulating signal is frequency modulated onto the carrier signal. Conveniently, both the carrier signal and the secondary signal may have respective frequencies greater than 20 kHz.

Preferably, the device is a smoking article for generating an inhalable aerosol.

In a second aspect of the present disclosure, there is provided an aerosol-delivery system. The aerosol-delivery system comprises an aerosol-generating device as described above and a reservoir of liquid aerosol-forming substrate in fluid communication with the vibratable transducer.

A wicking material may extend between the reservoir and the transducer to assist in conveying the liquid aerosol-forming substrate from the reservoir to the vibratable transducer. For example, the wicking material may have a porous or fibrous construction so as to convey the liquid substrate by capillary action. Alternatively or in addition, a pump may be provided to convey the liquid aerosol-forming substrate from the reservoir to the vibratable transducer.

Advantageously, the aerosol-delivery system is in the form of a consumer device configured for delivery of non-thermally generated aerosol. Preferably, the aerosol-delivery system is a smoking system configured for non-thermally generating an inhalable aerosol. As no heat is used in the generation of the aerosol, there is a reduced risk of producing harmful compounds, as these are usually associated with chemical reactions occurring at higher temperatures. Alternatively however, the aerosol-delivery system may be a smoking system comprising a heater element configured to apply heat to the liquid aerosol-forming substrate.

Preferably, the aerosol-delivery system comprises an elongate housing containing the aerosol-generating device and the reservoir, the elongate housing having a distal end and a mouth end, with a mouthpiece provided at the mouth end. Conveniently, the elongate housing is cylindrical. The aerosol-generating device is preferably arranged within the elongate housing such that aerosolised droplets ejected from the vibratable transducer would subsequently flow through the mouthpiece to exit the housing. Preferably, the elongate housing is sized and shaped to facilitate the housing being held between the thumb and fingers of a user of the aerosol-delivery system; this is particularly beneficial when the system is a smoking system. Conveniently, the aerosol-delivery system comprises a replaceable cartridge, the cartridge comprising the reservoir of liquid aerosol-forming substrate and being releasably positionable in the elongate housing.

Advantageously, the aerosol-delivery system further comprises a power source, the power source configured to provide electrical power to the controller, in which the controller and the power source are contained within the elongate housing. Preferably, the power source is rechargeable; for example, the power source may comprise a lithium ion battery. When the power source is rechargeable, the controller may also be configured to control charging of the power source.

The liquid aerosol-forming substrate used with the aerosol-generating device and the aerosol-delivery system may take many different forms. The following paragraphs describe various exemplary but non-limiting materials and compositions for the liquid aerosol-forming substrate.

The liquid aerosol-forming substrate may comprise nicotine. The nicotine-containing liquid aerosol-forming substrate may be a nicotine salt matrix. The liquid aerosol-forming substrate may comprise plant-based material. The liquid aerosol-forming substrate may comprise tobacco. The liquid aerosol-forming substrate may comprise homogenised tobacco material. The liquid aerosol-forming substrate may comprise a non-tobacco-containing material. The liquid aerosol-forming substrate may comprise homogenised plant-based material.

The liquid aerosol-forming substrate may comprise at least one aerosol-former. An aerosol-former is any suitable known compound or mixture of compounds that, in use, facilitates formation of a dense and stable aerosol. Suitable aerosol-formers are well known in the art and include, but are not limited to: polyhydric alcohols, such as triethylene glycol, 1,3-butanediol and glycerine; esters of polyhydric alcohols, such as glycerol mono-, di-, or triacetate; and aliphatic esters of mono-, di-, or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The liquid aerosol-forming substrate may comprise other additives and ingredients, such as flavourants.

The liquid aerosol-forming substrate may comprise water.

The liquid aerosol-forming substrate may comprise nicotine and at least one aerosol former. The aerosol former may comprise glycerine. The aerosol-former may comprise propylene glycol. The aerosol former may comprise both glycerine and propylene glycol. The liquid aerosol-forming substrate may have a nicotine concentration of between about 2% and about 10%.

In a third aspect of the present disclosure, there is provided a method of operating an aerosol-generating device having a vibratable transducer. The method comprises driving the transducer with a driving signal, in which all or part of the driving signal defines a sensory output of the transducer detectable by at least one of: an auditory sense of a user and a touch sense of a user. The aerosol-generating device, vibratable transducer and associated component parts may be as described in any of the preceding paragraphs for the first aspect of the present disclosure. As indicated in the preceding paragraphs, the driving signal may have a beneficial effect of both i) inducing vibration of the transducer (or a component part thereof) and ii) providing, through operation of the transducer, a sensory output detectable to a user of the aerosol-generating device.

Preferably, a reservoir of liquid aerosol-forming substrate is in fluid communication with the vibratable transducer. The method may further comprise driving the transducer so as to simultaneously provide the sensory output and aerosolise at least a portion of the liquid aerosol-forming substrate.

The method may comprise driving the transducer at one or more resonant frequencies of the vibratable transducer so as to aerosolise at least a portion of the liquid aerosol-forming substrate.

Preferably, the method may comprise adjusting the driving signal such that the sensory output is indicative of a state of the aerosol-generating device. As described in relation to the first aspect, the state may comprise one or more of the following: a temperature state of the aerosol-generating device; an energy state of the aerosol-generating device; a fault condition of the aerosol-generating device; a number of puffs applied by a user to the aerosol-generating device; and a phase of a usage session of the aerosol-generating device.

The method may also comprise adjusting a light signal emitted from the device so as to be indicative of the state of the aerosol-generating device. In this manner, the method is able to provide sensory feedback to a user in multiple formats. As described above, this feature can be particularly beneficial to users who have a sensory impairment.

As described in relation to the first aspect, preferably the driving signal comprises at least one predetermined frequency, whereby the sensory output comprises the at least one predetermined frequency. In this manner, the at least predetermined frequency defines how the sensory output is perceived by a user, whether through the user's auditory sense or the user's tactile sense.

Preferably, the at least one predetermined frequency comprises a first predetermined frequency and a second predetermined frequency. The method may further comprise: driving the transducer to vibrate at the first predetermined frequency when the device is in a first state; and driving the transducer to vibrate at the second predetermined frequency when the device is in a second state. The first and second states are different to each other. Additionally, the first and second predetermined frequencies are different to each other. The use of different predetermined frequencies for the different device states enables different auditory or tactile feedback to be provided for the different states.

As described in the discussion of the first aspect, the driving signal may comprise a sequence of two or more predetermined frequencies, wherein the sensory output comprises the sequence of the two or more predetermined frequencies. Additionally and also as described above, the sequence of two or more predetermined frequencies may define an auditory output of one or more spoken words. Additionally and also as described above, the at least one predetermined frequency may be less than 5 kHz, with most human speech composed of frequencies below 5 kHz.

As described in the discussion of the first aspect, the at least one predetermined frequency may comprise one or more of an up-chirp and a down-chirp.

As described in the discussion of the first aspect, conveniently the at least one predetermined frequency may lie within a range of 0.1 Hz to 20 kHz.

Preferably, the method may comprise driving the transducer with the driving signal, in which the driving signal comprises a carrier signal and a modulating signal. The modulating signal may be modulated onto the carrier signal, with the modulating signal comprising the at least one predetermined frequency. The beneficial effects of modulation are as described above in the discussion of the first aspect. The modulation of the carrier signal may take various forms. Conveniently, the modulating signal may be amplitude modulated onto the carrier signal with a modulation depth in a range of 10% to 100%. Alternatively or additionally, the modulating signal may be frequency modulated onto the carrier signal with a frequency deviation of between 1% to 50% of the carrier signal frequency.

Preferably, the method comprises driving the transducer with the driving signal, in which the driving signal comprises a carrier signal and a secondary signal, in which a frequency difference between the carrier signal and the secondary signal defines the predetermined frequency, the predetermined frequency being no greater than 20 kHz. As described in relation to the first aspect, limiting the frequency difference and thereby the predetermined frequency to being no greater than 20 kHz would have an effect that the sensory output may be perceived by a user's auditory and/or tactile senses as a series of beats at the predetermined frequency. As described in relation to the first aspect, the frequency difference and thereby the predetermined frequency may be confined to lie within a range of 20 Hz to 20 kHz, to provide an advantage that the frequency difference would result in a sensory output in the form of a sound within the auditory frequency range of human hearing. The controller may be configured such that the secondary signal is a modulating signal. For example and without limitation, the modulating signal may be frequency modulated onto the carrier signal. Conveniently, both the carrier signal and the secondary signal may have respective frequencies greater than 20 kHz.

In a fourth aspect of the present disclosure, there is provided a non-transitory computer readable medium having stored thereon instructions that, when executed by a processor of an aerosol-generating device having a vibratable transducer, cause the processor to perform the method as described above in relation to the third aspect. Preferably, the non-transitory computer readable medium would be incorporated into an aerosol-generating device (such as the aerosol-generating device of the first aspect). For example and without limitation, the medium may take the form of a computational memory module. Conveniently, the medium may form part of the controller of the device. Alternatively, the medium may be separate to but communicably coupled with the controller.

The invention is defined in the claims. However, below there is provided a non-exhaustive list of non-limiting examples. Any one or more of the features of these examples may be combined with any one or more features of another example, embodiment, or aspect described herein.

Example Ex1: An aerosol-generating device comprising: a vibratable transducer for aerosolising a liquid aerosol-forming substrate; and a controller coupled to the transducer; the controller configured to provide a driving signal for vibrating the transducer, in which all or part of the driving signal defines a sensory output of the transducer detectable by at least one of: an auditory sense of a user and a touch sense of a user.

Example Ex2: An aerosol-generating device according to example Ex1, in which the controller is configured such that the driving signal comprises one or more resonant frequencies of the vibratable transducer.

Example Ex3: An aerosol-generating device according to example Ex1, in which the controller is operable to switch between: a first operating condition in which the driving signal comprises one or more resonant frequencies of the vibratable transducer; and a second operating condition in which the driving signal excludes any resonant frequency of the vibratable transducer.

Example Ex4: An aerosol-generating device according to any one of examples Ex1 to Ex3, in which the transducer comprises a membrane, the membrane having an aerosol generation zone provided with a plurality of nozzles for the passage therethrough of liquid aerosol-forming substrate.

Example Ex5: An aerosol-generating device according to any one of examples Ex1 to Ex4, in which the controller is configured to adjust the driving signal such that the sensory output is indicative of a state of the aerosol-generating device.

Example Ex6: An aerosol-generating device according to example Ex5, in which the state comprises one or more of the following: a temperature state of the aerosol-generating device; an energy state of the aerosol-generating device; a fault condition of the aerosol-generating device; a number of puffs applied by a user to the aerosol-generating device; and a phase of a usage session of the aerosol-generating device.

Example Ex7: An aerosol-generating device according to either one of examples Ex5 or Ex6, in which the aerosol-generating device further comprises a light source configured to emit a light signal, wherein the controller is configured to adjust the light signal emitted from the light source so as to be indicative of the state of the aerosol-generating device.

Example Ex8: An aerosol-generating device according to any of examples Ex1 to Ex7, in which the controller is configured such that the driving signal comprises at least one predetermined frequency, whereby the sensory output comprises the at least one predetermined frequency.

Example Ex9: An aerosol-generating device according to Ex8, in which the controller is configured such that the driving signal comprises a sequence of two or more predetermined frequencies, wherein the sensory output comprises the sequence.

Example Ex10: An aerosol-generating device according to Ex9, in which the controller is configured such that the sequence of two or more predetermined frequencies defines an auditory output of one or more spoken words.

Example Ex11: An aerosol-generating device according to Ex10, in which the controller is configured such that the at least one predetermined frequency is less than 5 kHz.

Example Ex12: An aerosol-generating device according to any one of examples Ex8 to Ex11, in which the at least one predetermined frequency comprises one or more of an up-chirp and a down-chirp.

Example Ex13: An aerosol-generating device according to any one of examples Ex8 to Ex12, in which the controller is configured such that the at least one predetermined frequency lies within a range of 0.1 Hz to 20 kHz.

Example Ex14: An aerosol-generating device according to any one of examples Ex8 to Ex13, in which the controller is configured such that the driving signal comprises a carrier signal and a modulating signal, wherein the modulating signal is modulated onto the carrier signal, the modulating signal comprising the at least one predetermined frequency.

Example Ex15: An aerosol-generating device according to example Ex14, in which the modulating signal is amplitude modulated onto the carrier signal with a modulation depth in a range of 10% to 100%.

Example Ex16: An aerosol-generating device according to either one of example Ex14 or example Ex15, in which the modulating signal is frequency modulated onto the carrier signal with a frequency deviation of between 1% to 50% of the carrier signal frequency.

Example Ex17: An aerosol-generating device according to any one of examples Ex8 to Ex16, in which the controller is configured such that the driving signal comprises a carrier signal and a secondary signal, in which a frequency difference between the carrier signal and the secondary signal defines the predetermined frequency, the predetermined frequency being no greater than 20 kHz.

Example Ex18: An aerosol-generating device according to example Ex17, in which the controller is configured such that the secondary signal is a modulating signal, wherein the modulating signal is frequency modulated onto the carrier signal.

Example Ex19: An aerosol-generating device according to either one of example Ex17 or example Ex18, in which the frequency of both of the carrier signal and the secondary signal is greater than 20 kHz.

Example Ex20: An aerosol-generating device according to any one of examples Ex1 to Ex19, in which the device is a smoking article for generating an inhalable aerosol.

Example Ex21: An aerosol-delivery system, the system comprising: the aerosol-generating device according to any one of examples Ex1 to Ex20; the system further comprising: a reservoir of liquid aerosol-forming substrate in fluid communication with the vibratable transducer.

Example Ex22: An aerosol-delivery system according to example Ex21, in which the aerosol-delivery system comprises an elongate housing containing the aerosol-generating device and the reservoir, the elongate housing having a distal end and a mouth end, with a mouthpiece provided at the mouth end.

Example Ex23: An aerosol-delivery system according to example Ex22, further comprising a power source, the power source configured to provide electrical power to the controller, in which the controller and the power source are contained within the elongate housing.

Example Ex24: A method of operating an aerosol-generating device having a vibratable transducer, the method comprising: driving the transducer with a driving signal, in which all or part of the driving signal defines a sensory output of the transducer detectable by at least one of: an auditory sense of a user and a touch sense of a user.

Example Ex25: A method according to example Ex24, in which a reservoir of liquid aerosol-forming substrate is in fluid communication with the vibratable transducer, the method further comprising: driving the transducer so as to simultaneously provide the sensory output and aerosolise at least a portion of the liquid aerosol-forming substrate.

Example Ex26: A method according to either one of example Ex24 or example

Ex25, the method comprising driving the transducer at one or more resonant frequencies of the vibratable transducer so as to aerosolise at least a portion of the liquid aerosol-forming substrate.

Example Ex27: A method according to any one of examples Ex24 to Ex26, in which the method comprises adjusting the driving signal such that the sensory output is indicative of a state of the aerosol-generating device.

Example Ex28: A method according to example Ex27, in which the state comprises one or more of the following: a temperature state of the aerosol-generating device; an energy state of the aerosol-generating device; a fault condition of the aerosol-generating device; a number of puffs applied by a user to the aerosol-generating device; and a phase of a usage session of the aerosol-generating device.

Example Ex29: A method according to either one of example Ex27 or example Ex28, the method further comprising adjusting a light signal emitted from the device so as to be indicative of the state of the aerosol-generating device.

Example Ex30: A method according to any one of examples Ex24 to Ex29, in which the driving signal comprises at least one predetermined frequency, whereby the sensory output comprises the at least one predetermined frequency.

Example Ex31: A method according to example Ex30, in which the at least one predetermined frequency comprises a first predetermined frequency and a second predetermined frequency, the method comprising: driving the transducer to vibrate at the first predetermined frequency when the device is in a first state; and driving the transducer to vibrate at the second predetermined frequency when the device is in a second state; in which the first and second states are different to each other and the first and second predetermined frequencies are different to each other.

Example Ex32: A method according to either one of example Ex30 or example Ex31, in which the driving signal comprises a sequence of two or more predetermined frequencies, wherein the sensory output comprises the sequence.

Example Ex33: A method according to example Ex32, in which the sequence of two or more predetermined frequencies defines an auditory output of one or more spoken words.

Example Ex34: A method according to example Ex33, in which the at least one predetermined frequency is less than 5 kHz.

Example Ex35: A method according to any one of examples Ex30 to Ex34, in which the at least one predetermined frequency comprises one or more of an up-chirp and a down-chirp.

Example Ex36: A method according to any one of examples Ex30 to Ex35, in which the at least one predetermined frequency lies within a range of 0.1 Hz to 20 kHz.

Example Ex37: A method according to any one of examples Ex30 to Ex36, in which the method comprises driving the transducer with the driving signal, in which the driving signal comprises a carrier signal and a modulating signal, wherein the modulating signal is modulated onto the carrier signal, the modulating signal comprising the at least one predetermined frequency.

Example Ex38: A method according to example Ex37, in which the modulating signal is amplitude modulated onto the carrier signal with a modulation depth in a range of 10% to 100%.

Example Ex39: A method according to either one of example Ex37 or Ex38, in which the modulating signal is frequency modulated onto the carrier signal with a frequency deviation of between 1% to 50% of the carrier signal frequency.

Example Ex40: A method according to any one of examples Ex30 to Ex39, in which the method comprises driving the transducer with the driving signal, in which the driving signal comprises a carrier signal and a secondary signal, in which a frequency difference between the carrier signal and the secondary signal defines the predetermined frequency, the predetermined frequency being no greater than 20 kHz.

Example Ex41: A method according to example Ex40, in which the secondary signal is a modulating signal, wherein the modulating signal is frequency modulated onto the carrier signal.

Example Ex42: A non-transitory computer readable medium having stored thereon instructions that, when executed by a processor of an aerosol-generating device having a vibratable transducer, cause the processor to perform the method according to any of examples Ex24 to Ex41.

Examples will now be further described with reference to the figures, in which.

Figure 1:
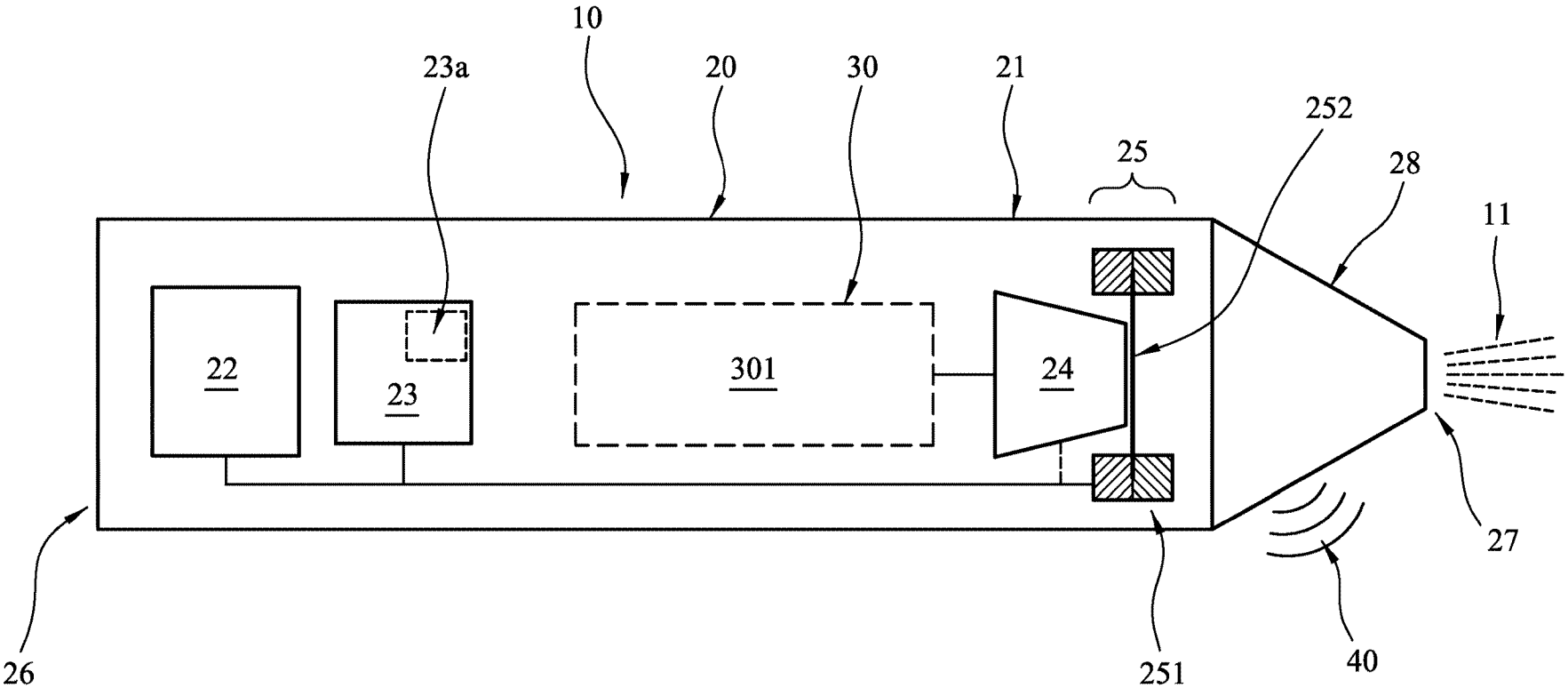
FIG. 1 shows a schematic view of a first embodiment of an aerosol-delivery system, the aerosol-delivery system being in the form of a smoking system for generating an inhalable aerosol.

FIG. 1 is a schematic view of an aerosol-delivery system 10. For the embodiment shown in FIG. 1, the aerosol-delivery system 10 is a smoking system for generating an inhalable aerosol 11. The system 10 has an aerosol-generating device 20 and a cartridge 30. The cartridge 30 contains a reservoir 301 of a liquid aerosol-forming substrate. For the embodiment shown, the cartridge 30 (illustrated with broken lines) is a replaceable component of the aerosol-delivery system 10, with the aerosol-generating device 20 being reusable with different cartridges 30.

The aerosol-generating device 20 has an elongate housing 21. The elongate housing 21 contains a power source 22, a controller 23, a liquid feed assembly 24 and a vibratable transducer 25. The power source 22 is coupled to the controller 23 and the vibratable transducer 25 to provide power thereto. For the embodiment shown, the power source 22 is a rechargeable battery, which serves as a source of electrical power. The controller 23 is configured to control operation of the vibratable transducer 25, including providing an electrical driving signal to the vibratable transducer. For the embodiment shown, the controller 23 takes the form of control electronics, and incorporates a memory module **23*a* containing instructions accessible by a processor (not shown) of the controller so as to control operation of the vibratable transducer 25. In an alternative embodiment (not shown), the controller 23 also serves to control charging of the rechargeable battery 22 when the battery is coupled to a charging unit. The vibratable transducer 25 has an annular piezo-electric actuator 251 and a membrane 252. The liquid feed assembly 24 is in the form of a wicking material extending between the cartridge 30 and the membrane 252 so as to progressively feed liquid from the reservoir 301 to an interior-facing surface of the membrane 252. In an alternative embodiment (not shown), the liquid feed assembly 24 is a pump powered by the power source 22. The elongate housing 21 has a distal end 26 and a mouth end 27. A mouthpiece 28 is provided at the mouth end 27 of the housing 21. The elongate housing 21 is adapted to enable the cartridge 30** to be removed and replaced from the housing.

Figure 2:
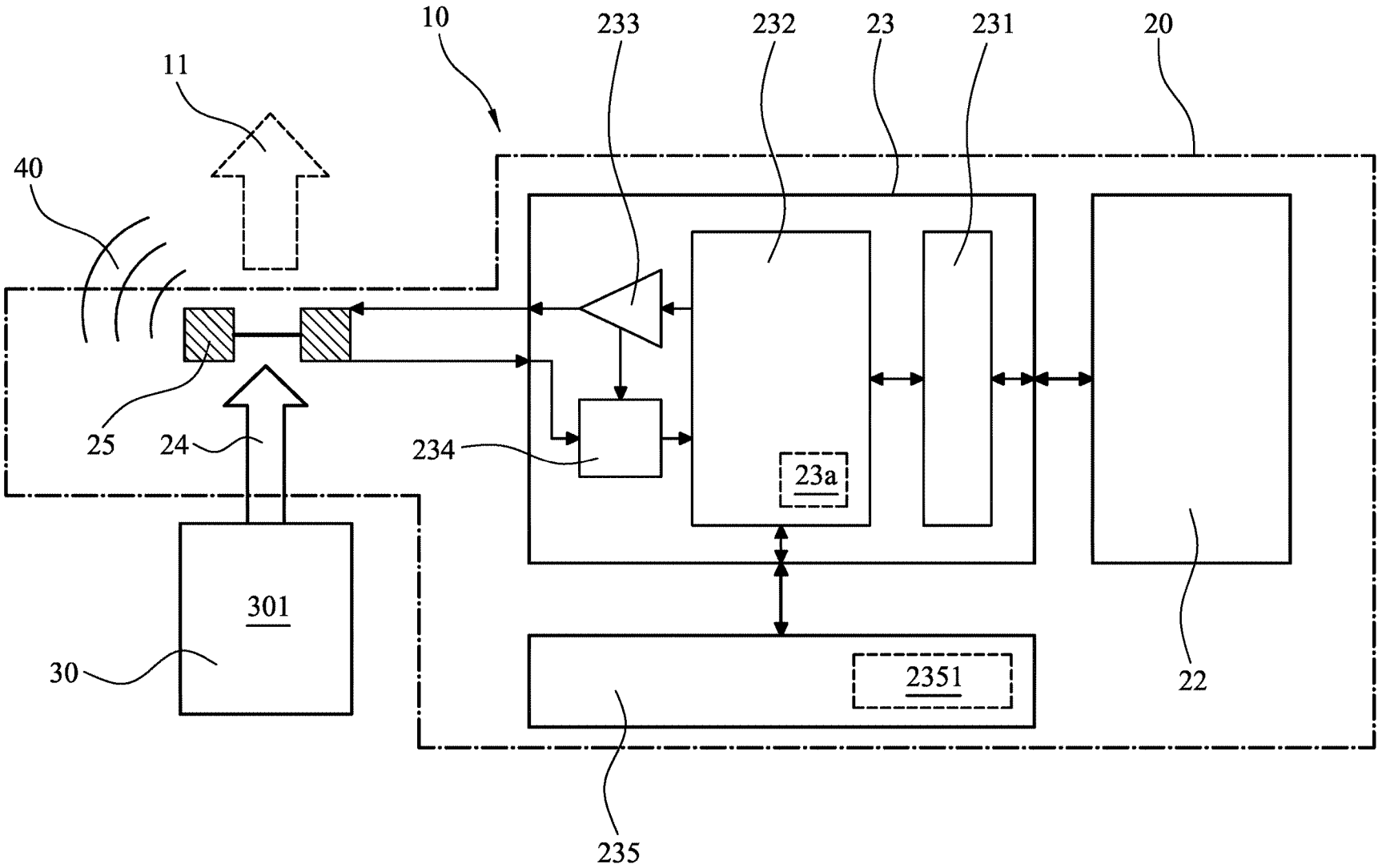
FIG. 2 shows a schematic view of a second embodiment of an aerosol-delivery system, the second embodiment being more generalised than the smoking system illustrated in FIG. 1.

FIG. 2 shows a more generalised view of the components of a second embodiment of an aerosol-delivery system 10. For FIGS. 1 and 2, like reference signs have been used for the same features. As shown in FIG. 2, the controller 23 includes a combined voltage regulator/charging circuit 231, a control unit 232, an amplifier 233 and voltage/current sensing circuitry 234. The control unit 232 incorporates the memory module **23*a* described above for the embodiment of FIG. 1. FIG. 2 also shows the presence of a user interface 235 coupled to the controller 23 for bi-directional communication with the controller. The user interface 235 includes an activating button (not shown) for activating the aerosol-delivery system 10. The user interface 235 also includes a light source 2351 in the form of an LED. A broken line in FIG. 2 encloses the components which form the aerosol-generating device 20 of the aerosol-delivery system 10**.

Figure 3:
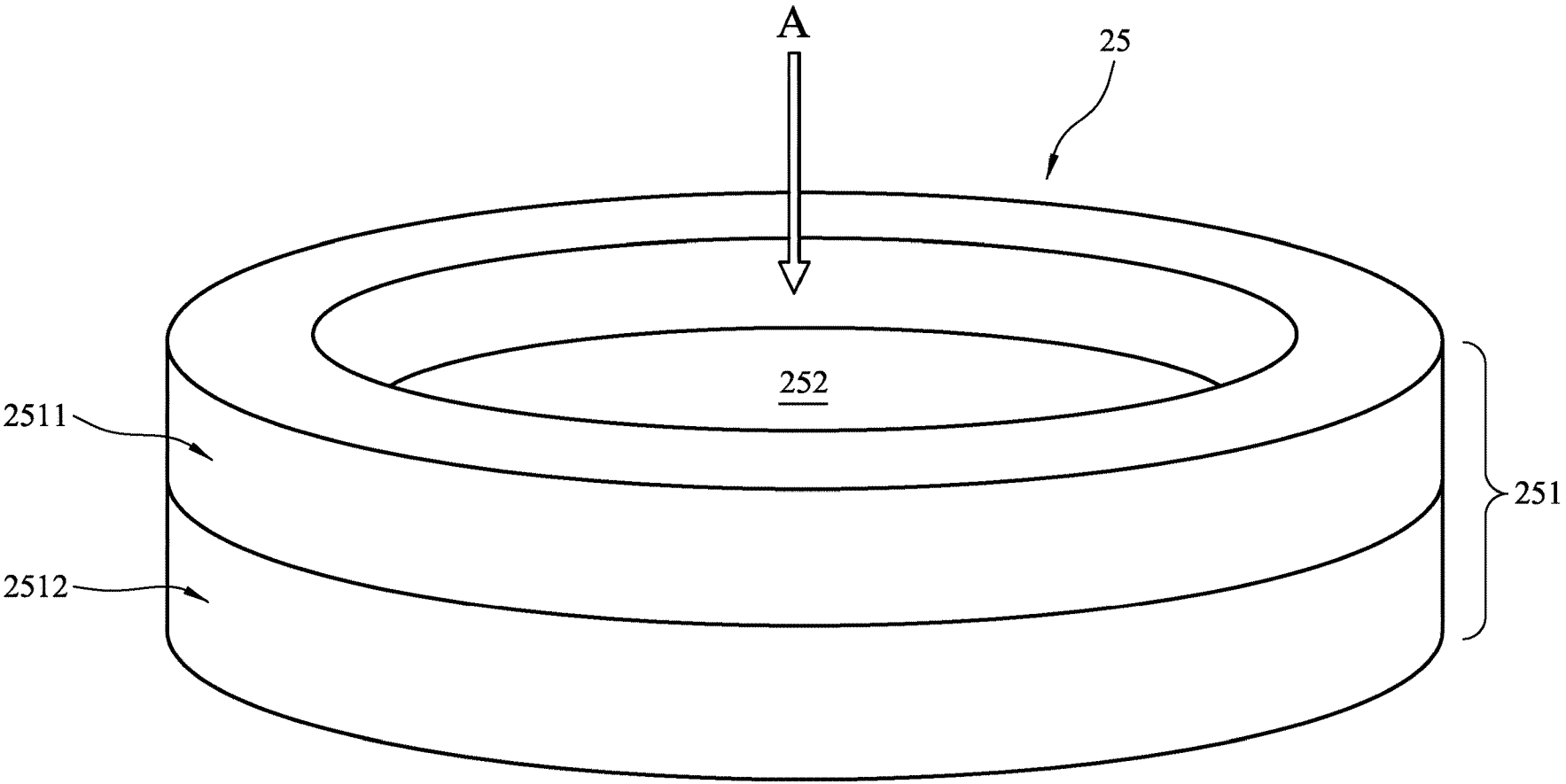
FIG. 3 shows a perspective view of a vibratable transducer as used in the aerosol-delivery systems of FIGS. 1 and 2.

FIG. 3 shows a perspective view of the vibratable transducer 25, which is generally circular in plan, i.e. when viewed in the direction of arrow A. The actuator 251 is annular, having the form of a continuous ring. The actuator 251 has an upper half 2511 and a lower half 2512. The membrane 252 is secured between the upper and lower halves 2511, 2512 of the actuator 251. In the embodiment shown, the membrane 252 is formed of a polymer material. However, as described above, other materials may be selected for the membrane 252, with the membrane material being one which has minimal to zero chemical reactivity with the composition of the liquid aerosol-forming substrate.

Figure 4:
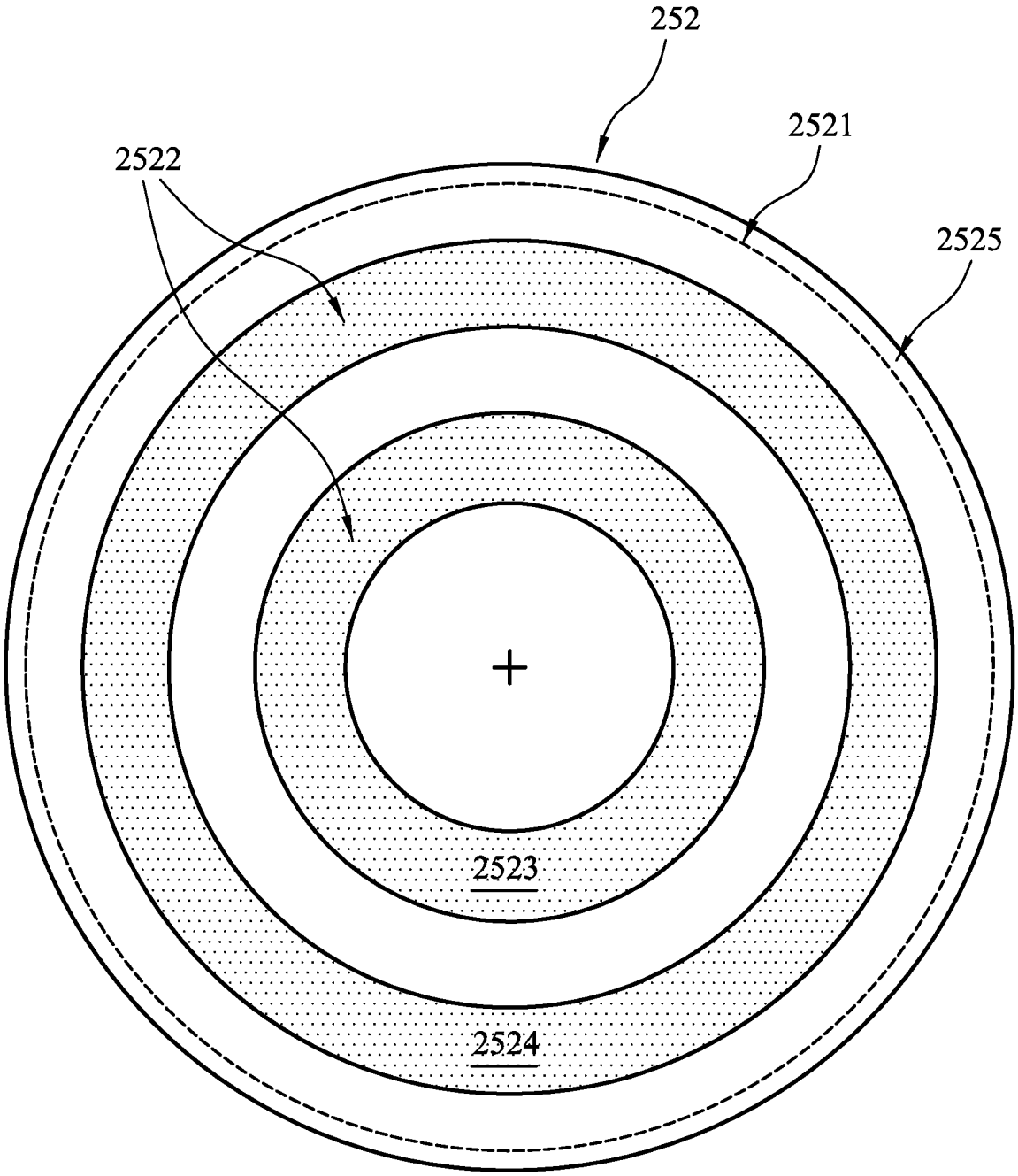
FIG. 4 shows a plan view of a membrane of a vibratable transducer used in the aerosol-delivery system of FIG. 1.

FIG. 4 shows a plan view of the membrane 252 of the vibratable transducer 25, i.e. when viewed in the direction of arrow A of FIG. 3. For convenience, the actuator 251 is excluded from FIG. 4. The membrane 252 is circular in plan view. The membrane 252 has an aerosol-generation zone 2521 (the periphery of which is represented by a broken line in FIG. 4). The aerosol generation zone 2521 is provided with a plurality of nozzles 2522 (represented by a pattern of dots in FIG. 4). The nozzles 2522 are in the form of holes extending through the thickness of the membrane 252. For the embodiment shown in FIG. 4, the plurality of nozzles 2522 are exclusively located in two annular regions 2523, 2524 of the aerosol-generation zone 2521. In an alternative embodiment (not shown), the nozzles 2522 are instead homogenously distributed across the entire surface area of the aerosol-generation zone 2521. An annular gap 2525 is present between the periphery of the membrane 252 and the periphery of the aerosol generation zone 2511. The annular gap 2525 provides space to enable the upper and lower halves 2511, 2512 of the actuator 251 to be coupled to the membrane 252, as per FIG. 3.

The vibratable transducer 25 is activated by an electrical driving signal provided by the controller 23 to the actuator 251. The controller 23 accesses the memory module 23*a* and generates the driving signal according to instructions stored in the memory module 23*a*. The driving signal results in a mechanical vibration signal being output from the actuator 251. The mechanical vibration signal of the actuator 251, in turn, induces a vibration of the membrane 252. In use of the aerosol-generating system 10, liquid aerosol-forming substrate is fed from the reservoir 301 to the interior facing surface of the membrane 252. The amplitude of the voltage of the driving signal and the frequency composition of the driving signal are defined by the controller 23 so as to induce a vibratory response of the membrane 252 sufficiently strong for a portion of the liquid aerosol-forming substrate to be urged through the nozzles 2522 and emitted from the outward facing surface of the membrane as a spray of aerosol droplets 11 (see FIGS. 1 and 2). However, as described in more detail below in relation to various embodiments, the driving signal generated by the controller 23 also defines a sensory output 40 (see FIGS. 1 and 2) of the transducer 25 detectable by one or both of the auditory sense or the touch sense of a user of the aerosol-delivery system 10.

Figure 5:
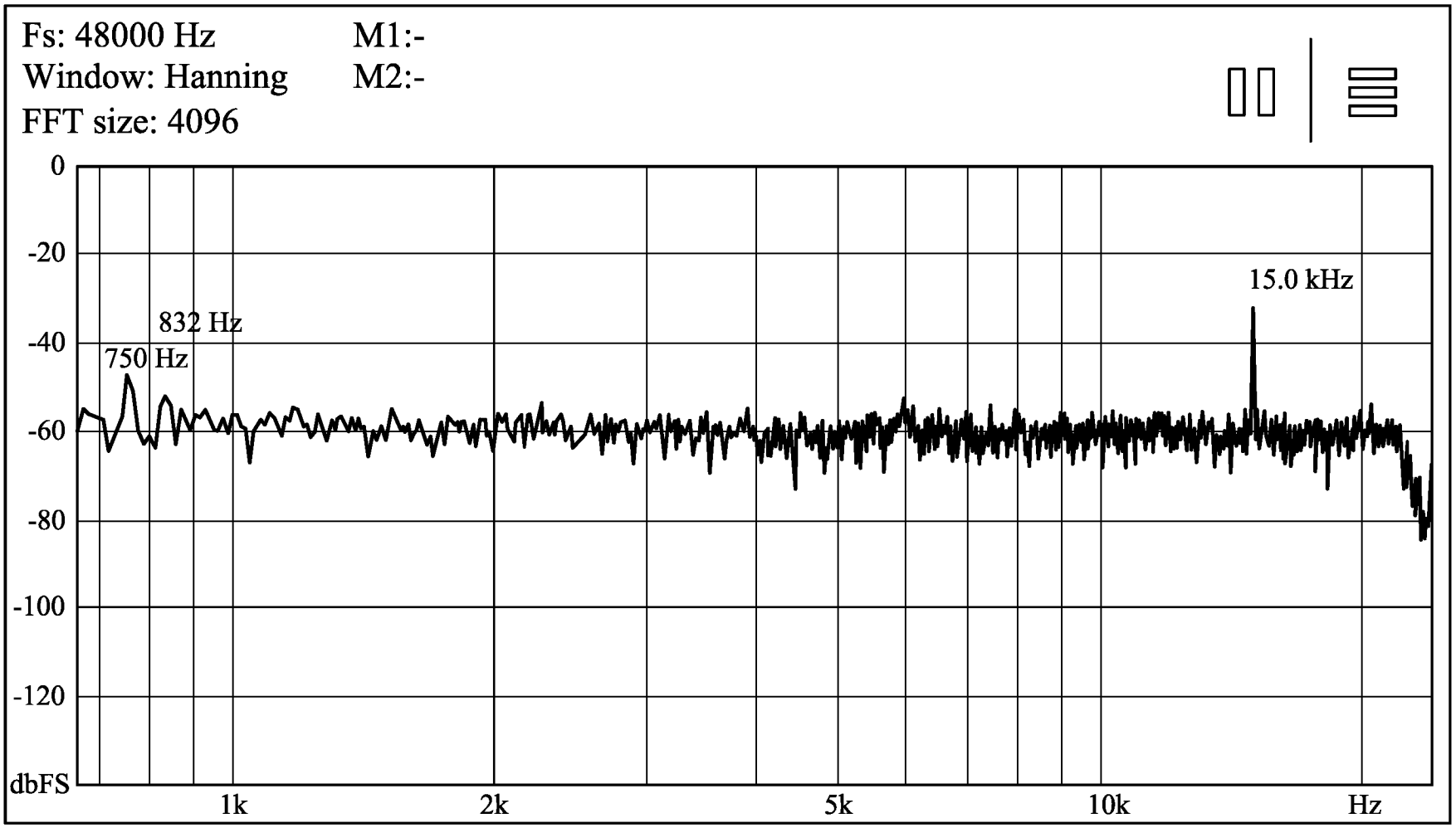
FIG. 5 shows a graph illustrating the frequency response of the membrane of the vibratable transducer of FIG. 3 when driven by a first exemplary driving signal.

In a first example described with reference to FIG. 5, the controller 23 generates a first exemplary driving signal for application to the vibratable transducer 25. The first exemplary driving signal takes the form of a sine carrier wave having a frequency of 135 kHz, the carrier wave amplitude modulated at 100% depth by a modulating wave having a frequency of 15 kHz. The frequency of the carrier wave substantially matches one of the resonant frequencies (~135 kHz) of the membrane 252 of the transducer 25. The application of this driving signal to the vibratable transducer 25 results in two effects. A first effect is that the carrier wave of the driving signal excites a vibration mode of the membrane 252 corresponding to the resonant frequency of 135 kHz for the membrane. Depending on the carrier wave having sufficient energy, the vibratory response of the membrane 252 would be sufficiently strong for a portion of the liquid aerosol-forming substrate to be urged through the nozzles 2522 of the membrane and emitted as a spray of aerosol droplets 11 (see FIGS. 1 and 2). The amplitude of the carrier wave is indicative of the energy of the carrier wave. A second effect is that the modulating wave of the driving signal results in either or both of the actuator 251 and the membrane 252 vibrating so as to generate an audible sensory output 40 of 15 kHz, i.e. within the auditory frequency range of human hearing. The right hand portion of the graph of FIG. 5 shows a corresponding peak in frequency response of the membrane 252 of 15 kHz, i.e. representing the audible sensory output 40. In this example, the membrane 252 can be thought of as acting like the diaphragm of a loudspeaker. The modulating wave present in the driving signal may also result in a vibratory response of part of the housing 21 of the aerosol-generating article, with this vibration providing a tactile sensory output 40 detectable to the user; for example, via the fingers of a user holding the device 20. In other embodiments, other frequencies may be chosen for the carrier wave and modulating wave. For example, the frequency of the carrier wave may be chosen according to the particular resonant frequencies of the membrane 252. Similarly, the frequency of the modulating wave may also be chosen according to the particular audible sensory output 40 which is desired.

Figure 6:
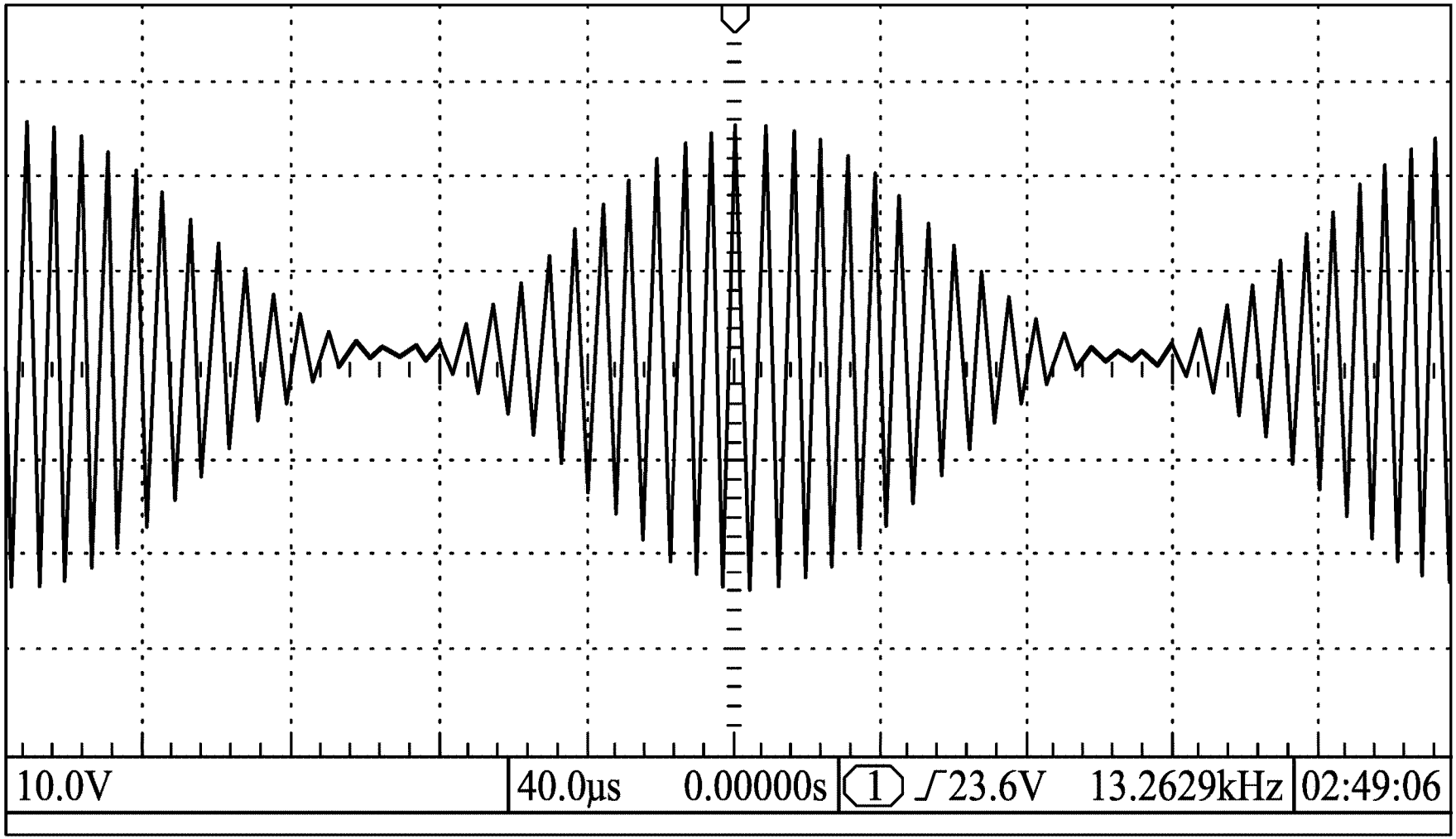
FIG. 6 shows a second exemplary driving signal as applied to the vibratable transducer of FIG. 3.
Figure 7:
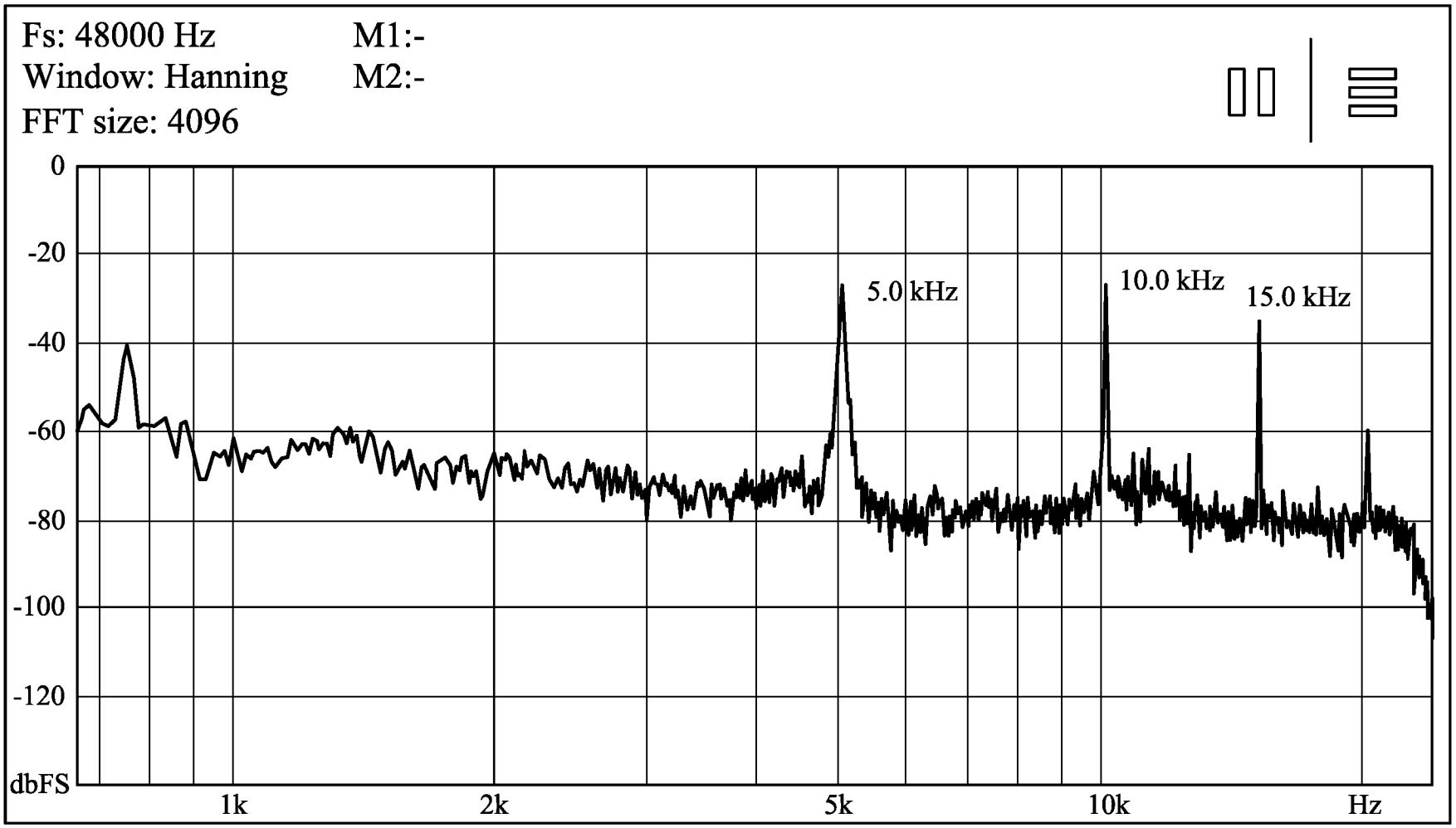
FIG. 7 shows a graph illustrating the frequency response of the membrane of the vibratable transducer of FIG. 3 when driven by the second exemplary driving signal of FIG. 6.

In a second example described with reference to FIGS. 6 and 7, the controller 23 generates a second exemplary driving signal for application to the vibratable transducer 25. This second example differs from the first example in that the carrier wave is instead modulated by a modulating wave having a frequency of only 5 kHz, instead of the 15 kHz of the first example discussed above. FIG. 6 illustrates the variation with time of the amplitude of the voltage of the driving signal for this second example. In this second example, the modulating wave of the driving signal results in either or both of the actuator 251 and the membrane 252 vibrating so as to generate an audible sensory output 40 of 5 kHz, as well as harmonic frequencies of 10 kHz and 15 kHz which are also within the auditory range of human hearing. These three audible frequency peaks are visible in the graph of FIG. 7. In a variation to this second example, filters (such as high band or low band filters) may be employed to attenuate the higher order harmonic frequencies and provide an auditory sensory output 40 consisting of only 5 kHz. As for the first example, the modulating wave present in the driving signal may also result in a vibratory response of part of the housing 21 of the aerosol-generating device 20, with this vibration providing a tactile sensory output 40 detectable to the user; for example, via the fingers of a user holding the device 20.

Figure 8:
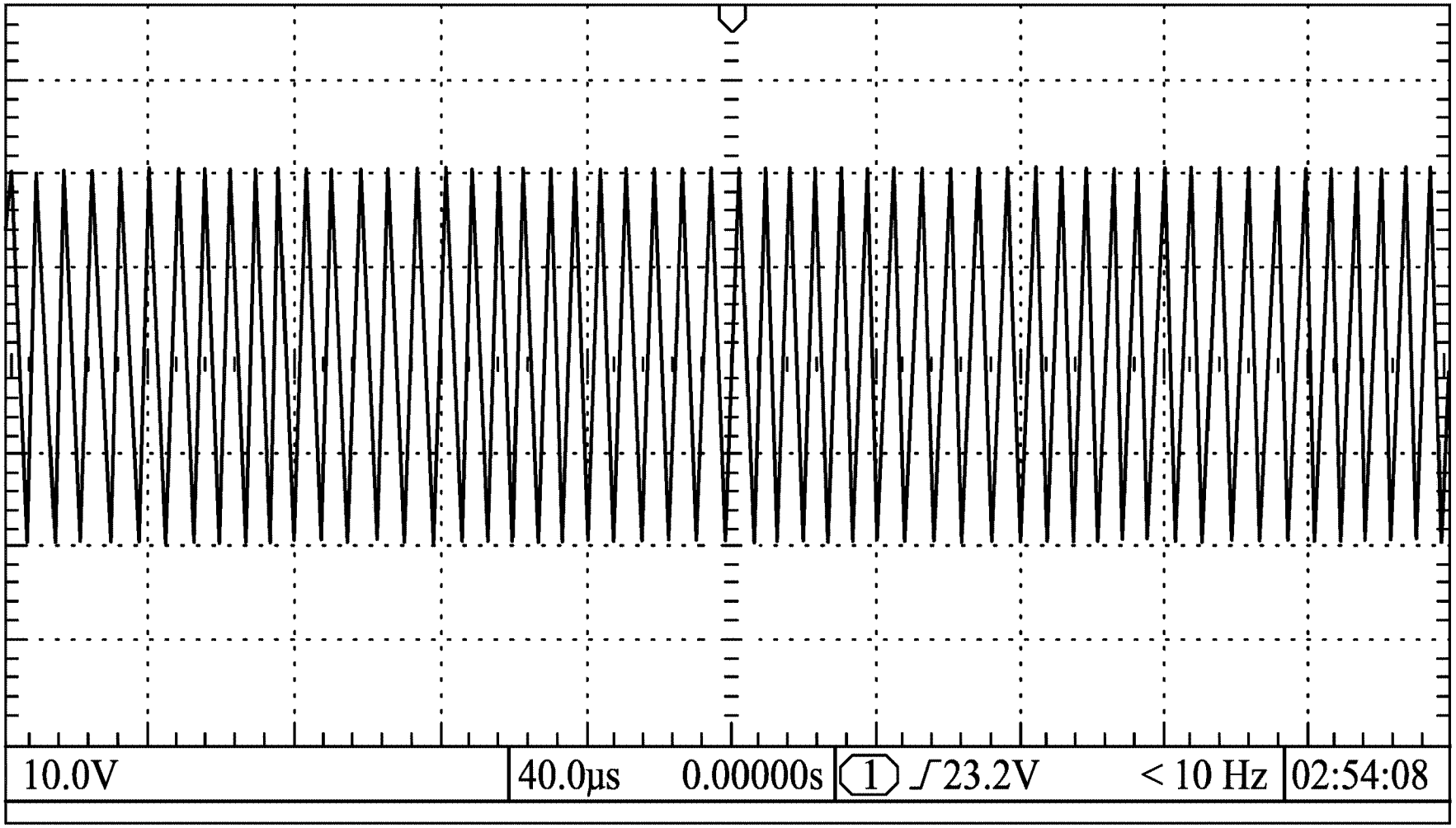
FIG. 8 shows a third exemplary driving signal as applied to the vibratable transducer of FIG. 3.
Figure 9:
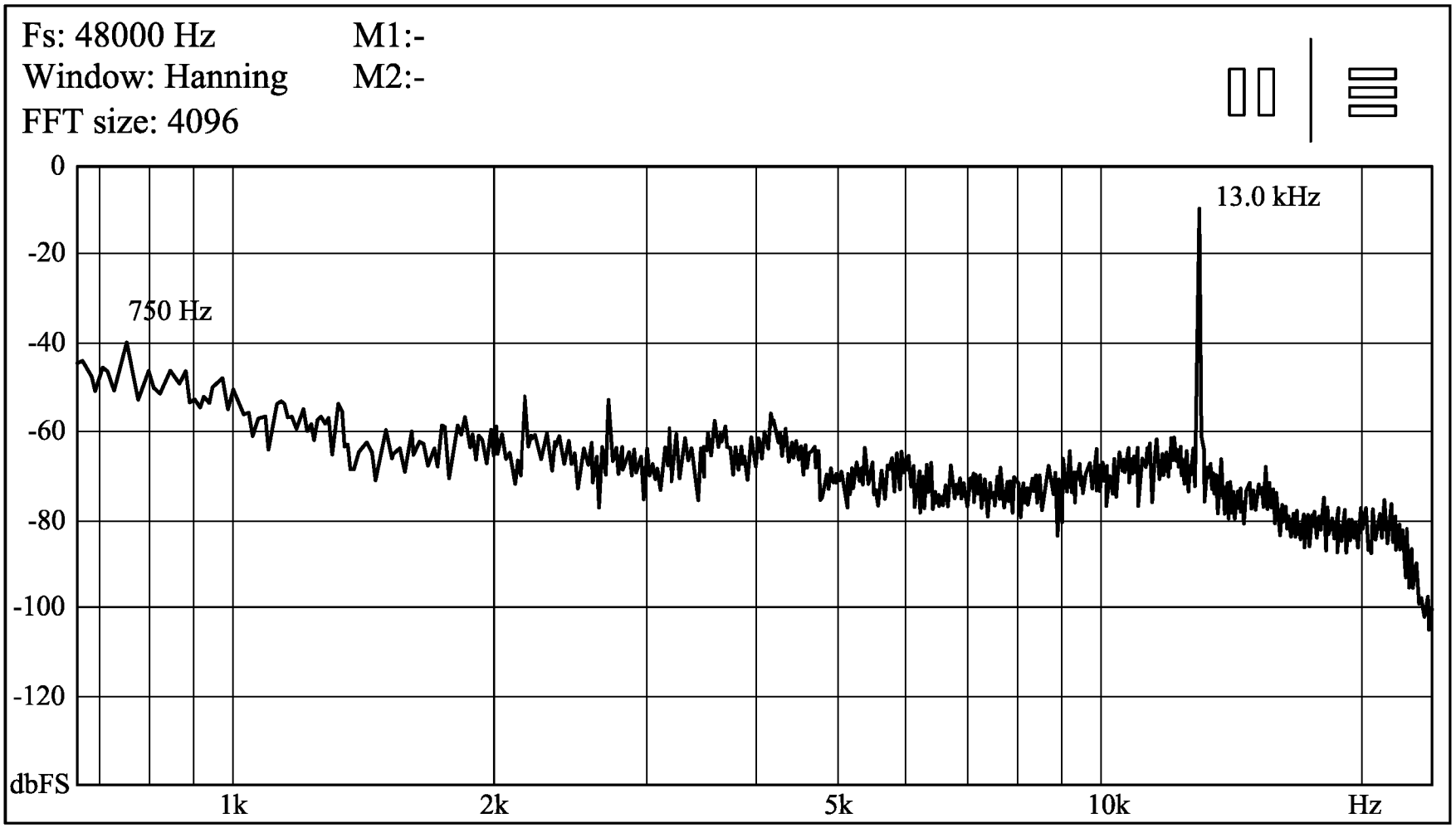
FIG. 9 shows a graph illustrating the frequency response of the membrane of the vibratable transducer of FIG. 3 when driven by the third exemplary driving signal of FIG. 8.

In a third example described with reference to FIGS. 8 and 9, the controller 23 generates a third exemplary driving signal for application to the vibratable transducer 25. This third example differs from the first and second examples in that the carrier wave is instead frequency modulated with a deviation of 10 kHz by a modulating wave having a frequency of 13 kHz. FIG. 8 illustrates the variation with time in the amplitude of the voltage of the driving signal for this third example. FIG. 9 shows the modulating wave of the driving signal resulting in either or both of the actuator 251 and the membrane 252 vibrating so as to generate an audible sensory output 40 of 13 kHz, i.e. within the auditory frequency range of human hearing. As for the first and second examples, the modulating wave present in the driving signal may also result in a vibratory response of part of the housing 21 of the aerosol-generating device 20, with this vibration providing a tactile sensory output 40 detectable to the user; for example, via the fingers of a user holding the device 20.

Figure 10:
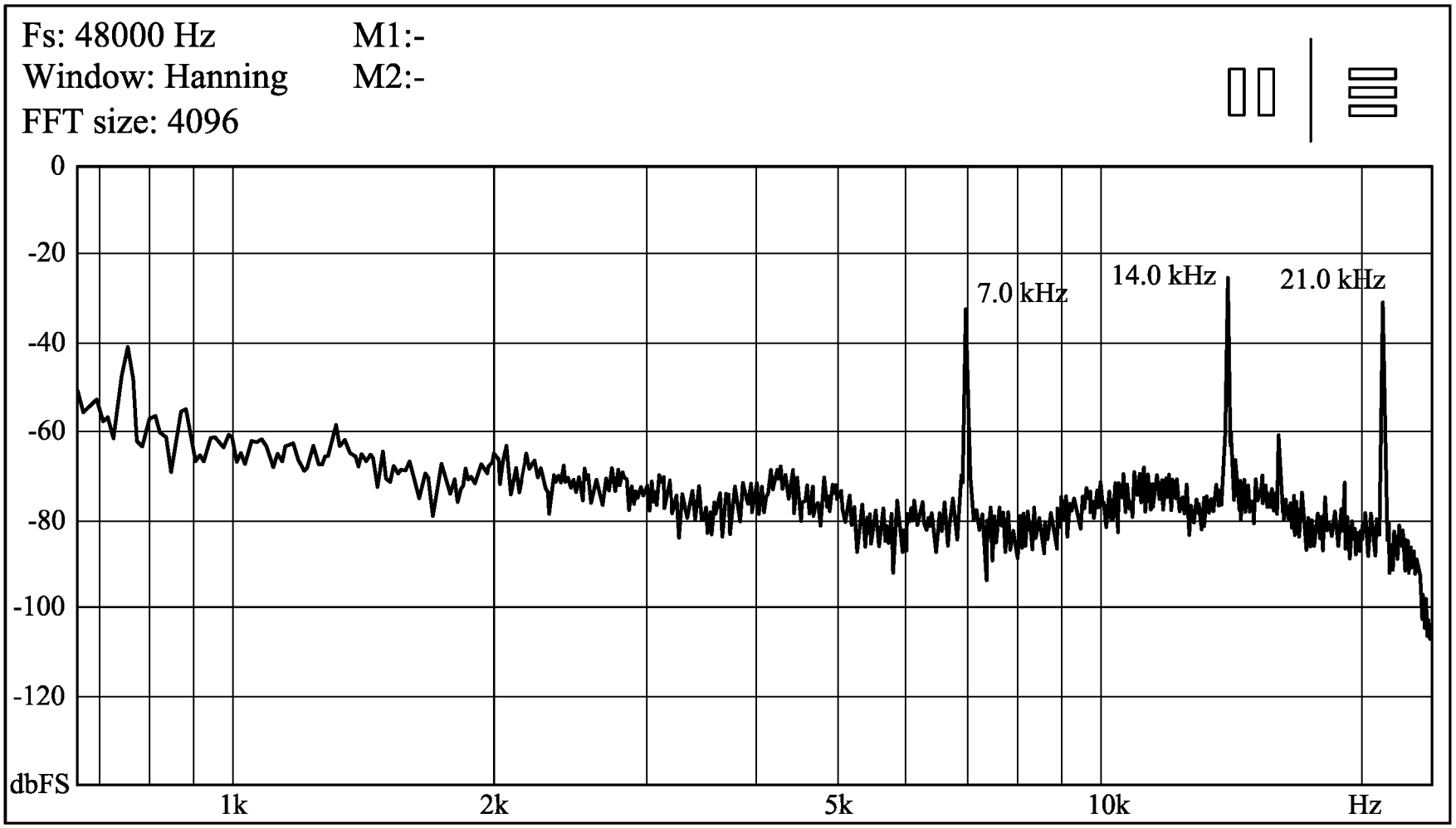
FIG. 10 shows a graph illustrating the frequency response of the membrane of the vibratable transducer of FIG. 3 when driven by a fourth exemplary driving signal.

In a fourth example described with reference to FIG. 10, the controller 23 generates a fourth exemplary driving signal for application to the vibratable transducer 25. This fourth example differs from the first, second and third examples in that the carrier wave is instead frequency modulated by a modulating wave having a frequency of 7 kHz. In this fourth example, the modulating wave of the driving signal results in either or both of the actuator 251 and the membrane 252 vibrating so as to generate an audible sensory output 40 of 7 kHz (see FIG. 10). Additionally, harmonic frequencies of 14 kHz and 21 kHz are also output, as can also be seen in FIG. 10. However, as 21 kHz is outside the generally accepted auditory frequency range for human hearing, only the tones at 7 kHz and 14 kHz would be sensed by the hearing of the user. As for the first, second and third examples, the modulating wave present in the driving signal may also result in a vibratory response of part of the housing 21 of the aerosol-generating device 20, with this vibration providing a tactile sensory output 40 detectable to the user; for example, via the fingers of a user holding the device 20.

Figure 11:
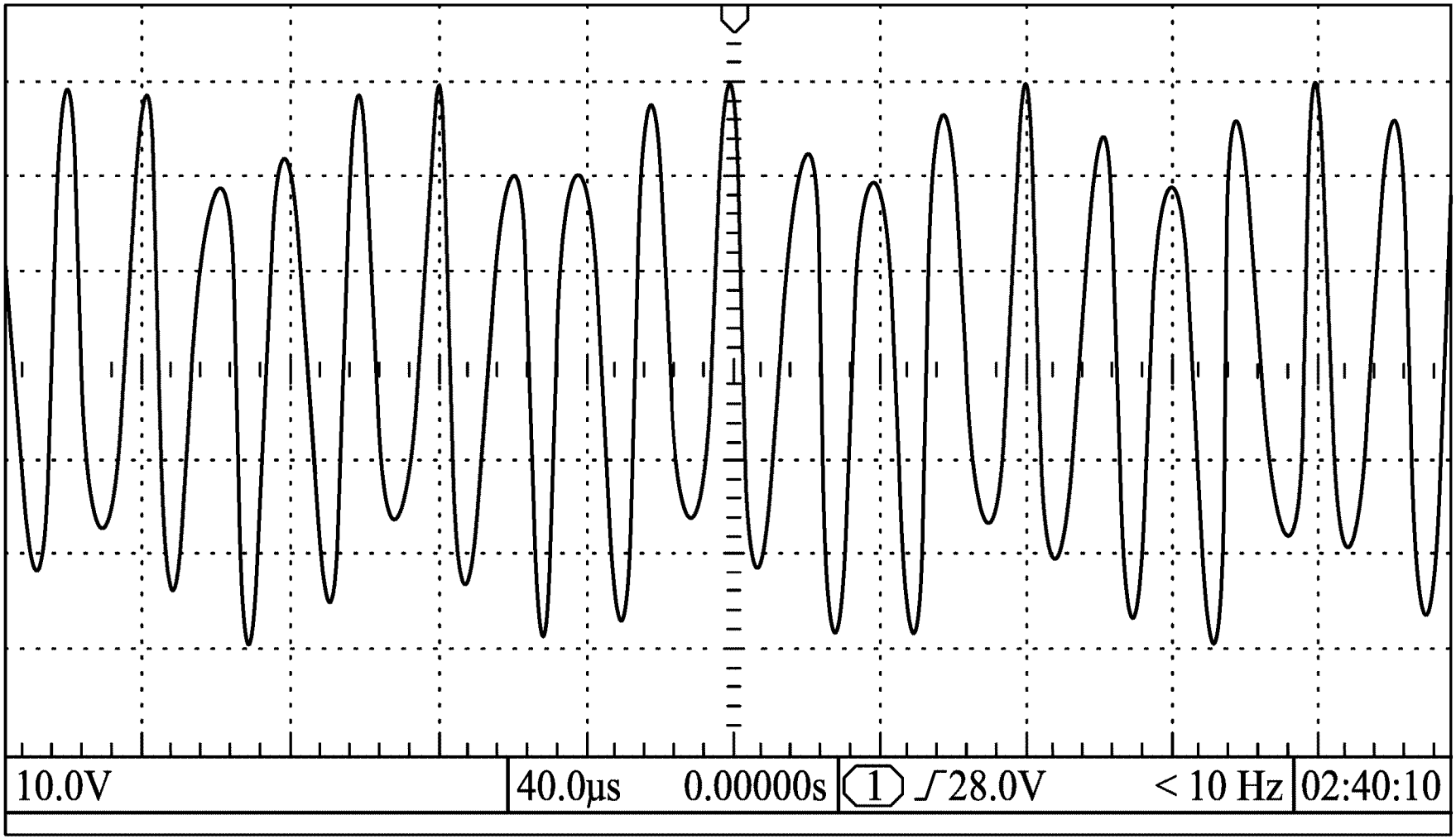
FIG. 11 shows a fifth exemplary driving signal as applied to the vibratable transducer of FIG. 3.
Figure 12:
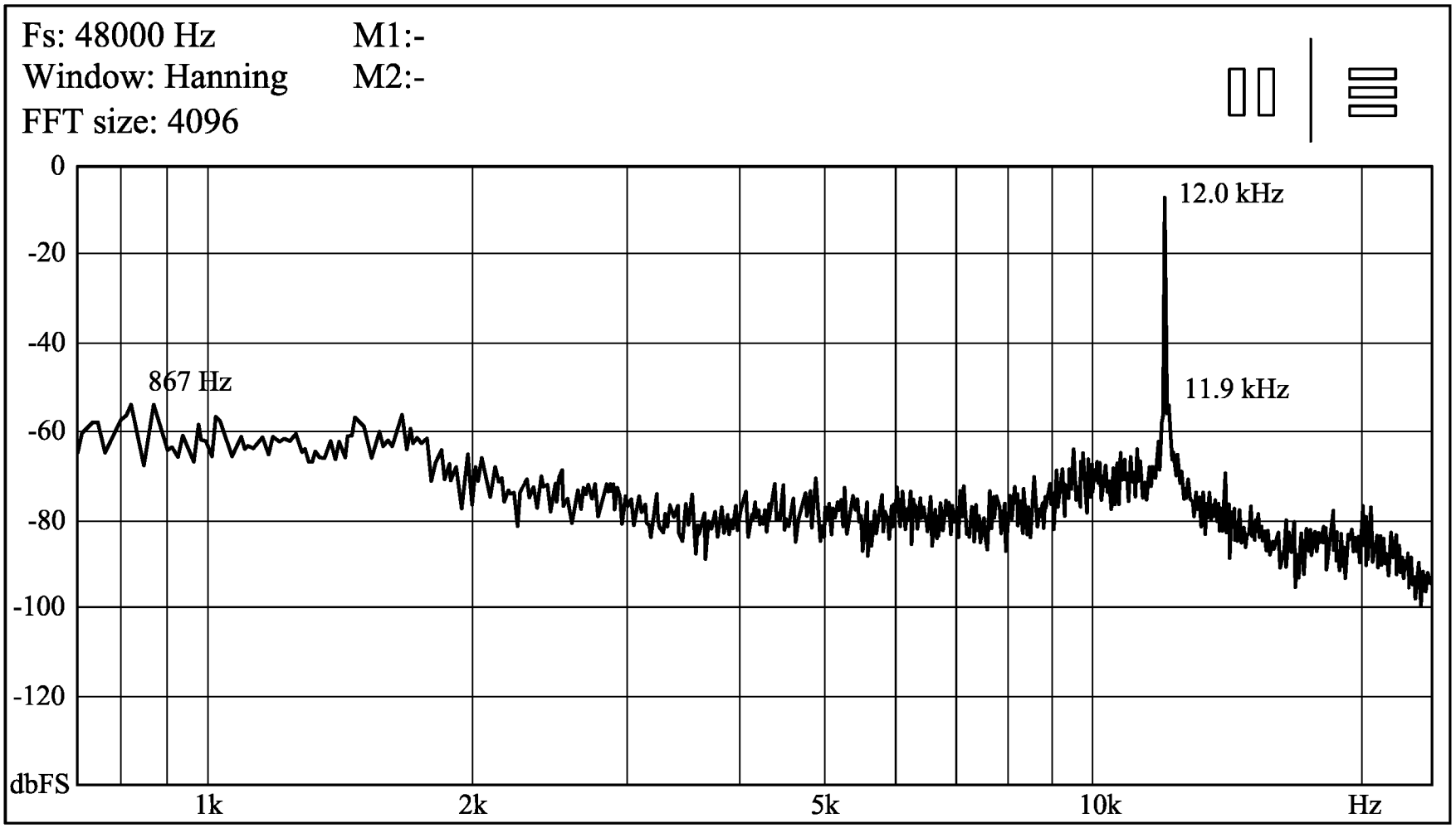
FIG. 12 shows a graph illustrating the frequency response of the membrane of the vibratable transducer of FIG. 3 when driven by the fifth exemplary driving signal of FIG. 11.

In a fifth example described with reference to FIGS. 11 and 12, the controller 23 generates a fifth exemplary driving signal for application to the vibratable transducer 25. However, this fifth example does not employ a modulating wave with a frequency in the auditory frequency range of human hearing. Rather, in this fifth example the controller 23 is configured to generate a driving signal having the form of a sine carrier wave having a frequency of 50 kHz, the carrier wave frequency modulated by a modulating wave having a frequency of 38 kHz. FIG. 11 illustrates the variation with time in the amplitude of the voltage of the driving signal for this fifth example. In this fifth example, the difference in frequency between the 50 kHz of the carrier wave and the 38 kHz of the modulating wave results in an audible pattern of beats at a frequency of 12 kHz (=50 kHz minus 38 kHz)—as illustrated by the peak in FIG. 12.

In variations which may be applied to any of the embodiments and examples described above, the controller 23 adjusts the composition of the driving signal used to excite the vibratable transducer 25 so as to vary the nature of the audible or tactile sensory output 40 according to a state of the aerosol-generating device 20. In one embodiment, the controller 23 is configured to provide a first driving signal corresponding to a first state in which the power source 22 has insufficient energy to power the device 20 (or component part(s) thereof), with the controller also configured to provide a second driving signal corresponding to a second state in which the device 22 is in a particular phase of a usage session. The first and second driving signals each use a common carrier wave in which the carrier wave is modulated by a modulating wave. However, the first and second driving signals differ in the frequency of their respective modulating waves, with the first driving signal employing a modulating wave having a frequency of 1 kHz and the second driving signal employing a modulating wave having a frequency of 4 kHz. The controller 23 provides the first driving signal to the vibratable transducer 25 when the aerosol-generating device 20 is in the first state, and provides the second driving signal to the vibratable transducer when the device is in the second state. This results in the membrane 252 of the transducer 25 vibrating so as to output a sensory output 40 in the form of an audible tone of 1 kHz when the aerosol-generating device 20 is in the first state, and vibrating so as to output a different sensory output 40 in the form of an audible tone of 4 kHz when the device is in the second state. In a variation to this embodiment, the controller 23 also controls the LED light source 2351 (see FIG. 2) to emit a first light signal of pulses of red light when the aerosol-generating device 20 is in the first state, and to emit a second light signal of pulses of yellow light when the aerosol-generating device is in the second state.

In yet another variation which may be applied to any of the embodiments and examples described above, the controller 23 is configured to have a first operation mode and a second operation mode, in which the first operation mode is an aerosol-generating mode for the aerosol-generating device 20 and the second operation mode is a non-aerosol generating mode for the device 20. In the aerosol-generating mode, the carrier wave of the driving signal would include one or more resonant frequencies of the membrane 252. In the non-aerosol generating mode, the carrier wave would exclude any of the resonant frequencies of the membrane 252, thereby reducing the vibratory response of the membrane 252 to a level which results in no or negligible aerosol droplets of the liquid aerosol-forming substrate being ejected from the nozzles 2522 of the membrane. In this alternative embodiment, the controller 23 is able to switch between the first and second operation modes according to instructions in the memory module 23*a* or user input provided to the controller 23 via the user interface 235. So, if the aerosol-generating device 22 is in a standby mode where no aerosol spray is desired, the controller 23 selects the non-aerosol generation mode; whereas if the device 22 is in an "on" mode in which a spray of aerosol is desired, the controller 23 selects the aerosol-generation mode.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number "A" is understood as "A"±10% of "A". Within this context, a number "A" may be considered to include numerical values that are within general standard error for the measurement of the property that the number "A" modifies. The number "A", in some instances as used in the appended claims, may deviate by the percentages enumerated above provided that the amount by which "A" deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating device, comprising:

a vibratable transducer configured to aerosolise a liquid aerosol-forming substrate; and a controller coupled to the transducer, the controller being configured to provide a driving signal for vibrating the transducer, in which all or part of the driving signal defines a sensory output of the transducer detectable by at least one of an auditory sense of a user and a touch sense of a user, and adjust the driving signal such that the sensory output is indicative of a state of the aerosol-generating device, wherein the controller is operable to switch between:

a first operating condition in which the driving signal comprises one or more resonant frequencies of the vibratable transducer, and a second operating condition in which the driving signal excludes any resonant frequency of the vibratable transducer.

2. The aerosol-generating device according to claim 1, wherein the state comprises one or more of the following:

a temperature state of the aerosol-generating device, an energy state of the aerosol-generating device, a fault condition of the aerosol-generating device, a number of puffs applied by the user to the aerosol-generating device, and a phase of a usage session of the aerosol-generating device.

3. The aerosol-generating device according to claim 1, wherein the controller is further configured such that the driving signal comprises one or more resonant frequencies of the vibratable transducer.

4. The aerosol-generating device according to claim 1, wherein the transducer comprises a membrane, the membrane having an aerosol generation zone provided with a plurality of nozzles for passage therethrough of the liquid aerosol-forming substrate.

5. The aerosol-generating device according to claim 1, wherein the controller is further configured such that the driving signal comprises at least one predetermined frequency, whereby the sensory output comprises the at least one predetermined frequency.

6. The aerosol-generating device according to claim 5, wherein the controller is further configured such that the driving signal comprises a sequence of two or more predetermined frequencies, and wherein the sensory output comprises the sequence.

7. The aerosol-generating device according to claim 5, wherein the controller is further configured such that the at least one predetermined frequency is within a range of 0.1 Hz to 20 KHz.

8. The aerosol-generating device according to claim 5, wherein the controller is further configured such that the driving signal comprises a carrier signal and a modulating signal, and wherein the modulating signal is modulated onto the carrier signal, the modulating signal comprising the at least one predetermined frequency.

9. An aerosol-delivery system, comprising:

the aerosol-generating device according to claim 1;

a reservoir of liquid aerosol-forming substrate in fluid communication with the vibratable transducer; and an elongate housing containing the aerosol-generating device and the reservoir, the elongate housing having a distal end and a mouth end, with a mouthpiece provided at the mouth end.

* * * * *